US006161477A

United States Patent [19]

Hara et al.

[11] Patent Number: 6,161,477

[45] **Date of Patent: *Dec. 19, 2000**

[54] WEB ANTI-WRAP DEVICE FOR WEB PRINTING PRESS

[75] Inventors: Akira Hara, Tokyo; Kazuteru Kawazoe, Ichihara, both of Japan

[73] Assignee: Baldwin-Japan Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/002,940

[22] Filed: Jan. 5, 1998

[30] Foreign Application Priority Data

Jan. 21, 1997 [JP] Japan ..... 9-023207

[51] Int. Cl.[7] ..... B41F 13/02

[52] U.S. Cl. ..... 101/219; 101/484; 226/11

[58] Field of Search ..... 226/11; 101/219, 101/484, 226, 228

[56] References Cited

U.S. PATENT DOCUMENTS

| | | | |
|---|---|---|---|
| 4,887,532 | 12/1989 | Kotterer | 226/11 |
| 5,063,845 | 11/1991 | Perretta | 226/11 |
| 5,275,105 | 1/1994 | Schweizer et al. | 101/477 |
| 5,372,290 | 12/1994 | Marmin | 101/228 |
| 5,398,610 | 3/1995 | Pavliny et al. | 101/484 |
| 5,443,008 | 8/1995 | Pavilny et al. | 101/484 |

FOREIGN PATENT DOCUMENTS

| | | |
|---|---|---|
| 0 442 824 A2 | 10/1991 | European Pat. Off. . |
| 2 263 437 | 7/1993 | United Kingdom . |

*Primary Examiner*—John S. Hilten
*Assistant Examiner*—Leslie J. Grohusky
*Attorney, Agent, or Firm*—Morgan & Finnegan, L.L.P.

[57] ABSTRACT

In a web anti-wrap device for a web printing press, anti-wrap means is disposed between printing cylinders and a processing device which is positioned downstream of the printing cylinders in the printing press, to prevent a broken web from wrapping around the printing cylinders. Guide means is provided for guiding the anti-wrap means for movement between a first position in which the anti-wrap means fulfills the function to prevent the broken web from wrapping, and a second position in which the anti-wrap means is moved away from the first position to create a working space between the anti-wrap means and the printing cylinders or between the anti-wrap means and the processing device.

4 Claims, 6 Drawing Sheets

WEB ANTI-WRAP DEVICE FOR WEB PRINTING PRESS

BACKGROUND OF THE INVENTION

1. Field of the Invention

The invention relates to a web anti-wrap device for a web printing press for preventing a broken web from wrapping around the printing cylinders of the printing press.

2. Description of Related Art

There has been generally used a web printing press which comprises a plurality of printing units arranged in a web feeding direction. The printing units each includes printing cylinders such as blanket cylinders and plate cylinders, through which a web is fed to be printed. The printing press further comprises a dryer unit, a chill unit and a folder unit which are disposed downstream of the printing cylinders in the last printing unit. The printed web is discharged from the last printing unit and directed into and heated in the dryer unit. The web is then directed into and cooled in the chill unit and directed into and folded in the folder unit.

In the printing press, the web may be accidentally broken by thermal stresses in the dryer unit or the chill unit. The web may also be accidentally broken by fluctuating tensions in the folder unit. The printing press is slowed and stopped in response to a signal from a detector detecting the web break. However, before the printing press is stopped, the broken web may be directed back to and wrapped around the printing cylinders. This results in substantial down time for removing the wrapped web from the printing cylinders. When the broken web is wrapped around a blanket cylinder including a blanket, the blanket may be damaged by the wrapped web. It is therefore required to frequently exchange the blankets for new ones, involving an expense.

In order to overcome the problems, there has been proposed a web anti-wrap device as disclosed in U.S. Pat. No. 5,398,610 and U.S. Pat. No. 5,443,008. The anti-wrap device includes anti-wrap means comprising upper and lower anti-wrap rollers which are disposed between the last printing unit and the dryer unit. The anti-wrap rollers are engaged with each other when the web is broken, to capture the broken web therebetween and pull it from the last printing unit for preventing the broken web from wrapping around the printing cylinders. The web is directed from the last printing unit by the anti-wrap rollers and harmlessly gathered in a shop floor space between the anti-wrap rollers and the dryer unit.

Under the circumstances, in the existing presses as well, an attempt has been made to additionally install the anti-wrap means between the last printing unit and the dryer unit. However, it has a problem with respect to the space between the last printing unit and the dryer unit. A limited space as the existing press has between the last printing unit and the dryer unit, the space is intended to utilize for making preparations for the printing operation. For example, an operator use the space to mount plates onto the plate cylinders. The operator then inspects in the space how the plates are mounted on the plate cylinders. It is also required to inspect in the space the dirt of the plates. The operator further use the space to exchange the blankets of the blanket cylinders for new ones. It is also required to watch in the space the ink and dampening water in the printing press.

On the other hand, in order to additionally install the anti-wrap means between the last printing unit and the dryer unit in the existing press, it is required to position the anti-wrap means apart from the dryer unit so as to create a shop floor space therebetween so that the broken web can be harmlessly gathered in the shop floor space when directed from the the last printing unit by the anti-wrap means. In addition, the anti-wrap means should include detectors for detecting a web break, as described in the above U.S. Patents. It is therefore required to position the anti-wrap means apart from the dryer unit so as to keep the anti-wrap means from being heated by the dryer unit, otherwise the detectors may be damaged. In this connection, it is not permissible to position the anti-wrap means apart from the last printing unit so as to create a working space between the anti-wrap means and the last printing unit for making preparations for the printing operation. The operator is hindered from making preparations by the anti-wrap means.

On the contrary, it may be also desired to create a working space between the anti-wrap means and the dryer unit for maintenance of the dryer unit.

It is therefore an object of the invention to provide a new and improved web anti-wrap device for a web printing press, to thereby overcome the above problems.

Another object of the invention is to additionally install anti-wrap means between printing cylinders and a processing device which is disposed downstream of the printing cylinders in the existing press, to prevent a broken web from wrapping around the printing cylinders.

Other object of the invention is to create a shop floor space between the anti-wrap means and the processing device so that the broken web can be harmlessly gathered in the shop floor space.

Other object of the invention is to keep the anti-wrap means from being heated by the processing device which comprises a dryer unit.

Other object of the invention is to create a working space between the anti-wrap means and the printing cylinders or between the anti-wrap means and the processing device.

SUMMARY OF THE INVENTION

According to the invention, there is provided a web anti-wrap device for a web printing press comprising anti-wrap means disposed between printing cylinders and a processing device which is disposed downstream of the printing cylinders in the printing press, to prevent a broken web from wrapping around the printing cylinders. The anti-wrap device further comprises guide means for guiding the anti-wrap means for movement between a first position in which the anti-wrap means fulfills the function to prevent the broken web from wrapping, and a second position in which the anti-wrap means is moved away from the first position to create a working space between the anti-wrap means and the printing cylinders or between the anti-wrap means and the processing device.

In a preferred embodiment, the guide means is arranged to guide the anti-wrap means for movement in a web feeding direction.

The printing press may comprise a plurality of printing units arranged in a web feeding direction, the printing units each including the printing cylinders through which the web is fed to be printed. The processing device comprises a dryer unit which is disposed downstream of the printing cylinders in the last printing unit. The anti-wrap means comprises upper and lower anti-wrap rollers disposed between the last printing unit and the dryer unit. The anti-wrap rollers are engaged with each other when a web is broken, to capture the broken web therebetween and pull it from the last printing unit for preventing the broken web from wrapping around the printing cylinders.

The guide means may comprise rail means extending between the first and second positions. The anti-wrap means is movable along the rail means.

The anti-wrap means may be mounted on a table disposed between the printing cylinders and the processing device. The table includes the guide means for guiding the anti-wrap means for movement relative to the table.

The guide means may be arranged to guide the anti-wrap means for pivotal movement about the upper or lower end of the anti-wrap device from the first position to the second position to create the working space.

The table may include the guide means for guiding the anti-wrap means for pivotal movement relative to the table.

The anti-wrap device may further comprise actuator means for moving the anti-wrap means in response to a signal from the printing press.

The printing press may generate the signal in relation to the printing speed.

DETAILED DESCRIPTION OF THE PREFERRED EMBODIMENTS

Figure 1:
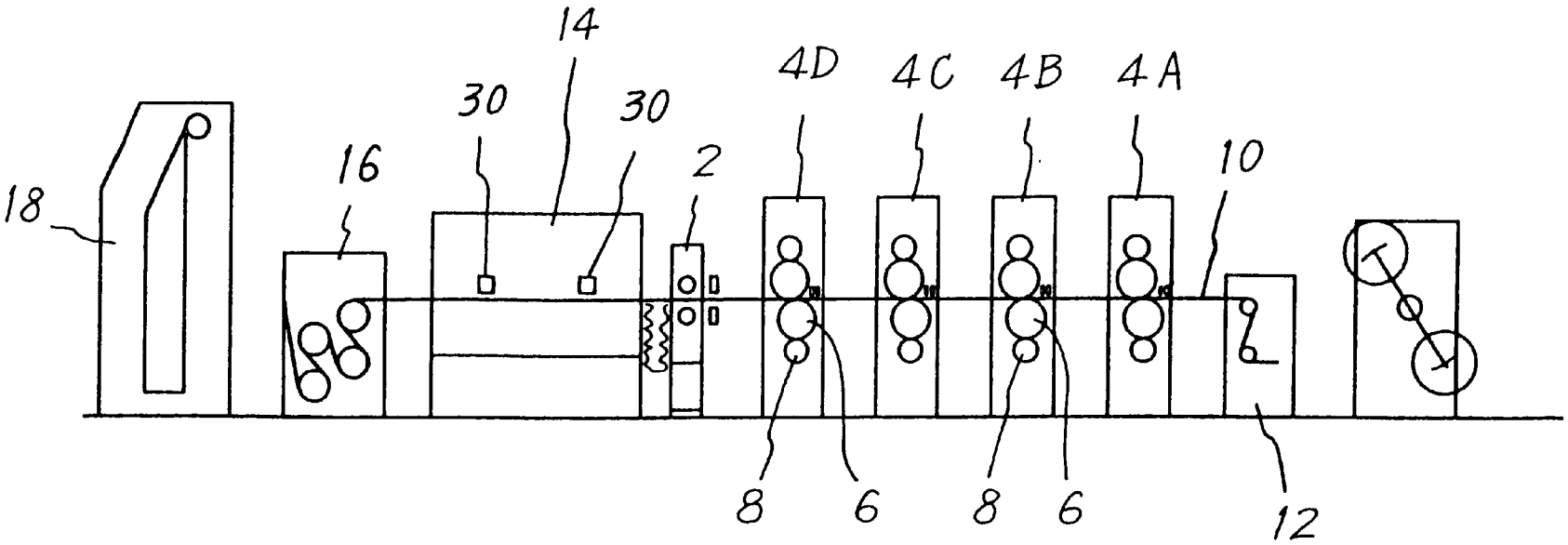
FIG. 1 is a schematic view illustrating a web anti-wrap device for a web printing press according to the invention.

Turning now to the drawings, FIG. 1 illustrates a web anti-wrap device 2 for a web printing press according to the invention. The printing press comprises a plurality of printing units 4A to 4D arranged in a web feeding direction. The printing units 4A to 4D each includes printing cylinders such as blanket cylinders 6 and plate cylinders 8, through which a web 10 is fed from an infeed 12 to be printed. The printing press further comprise a dryer unit 14, a chill unit 16 and a folder unit 18 which are disposed downstream of the printing cylinders 6 and 8 in the last printing unit 4D. The printed web 10 is discharged from the last printing unit 4D and directed into and heated in the dryer unit 14. The web 10 is then directed into and cooled in the chill unit 16 and directed into and folded in the folding device 18.

Figure 2:
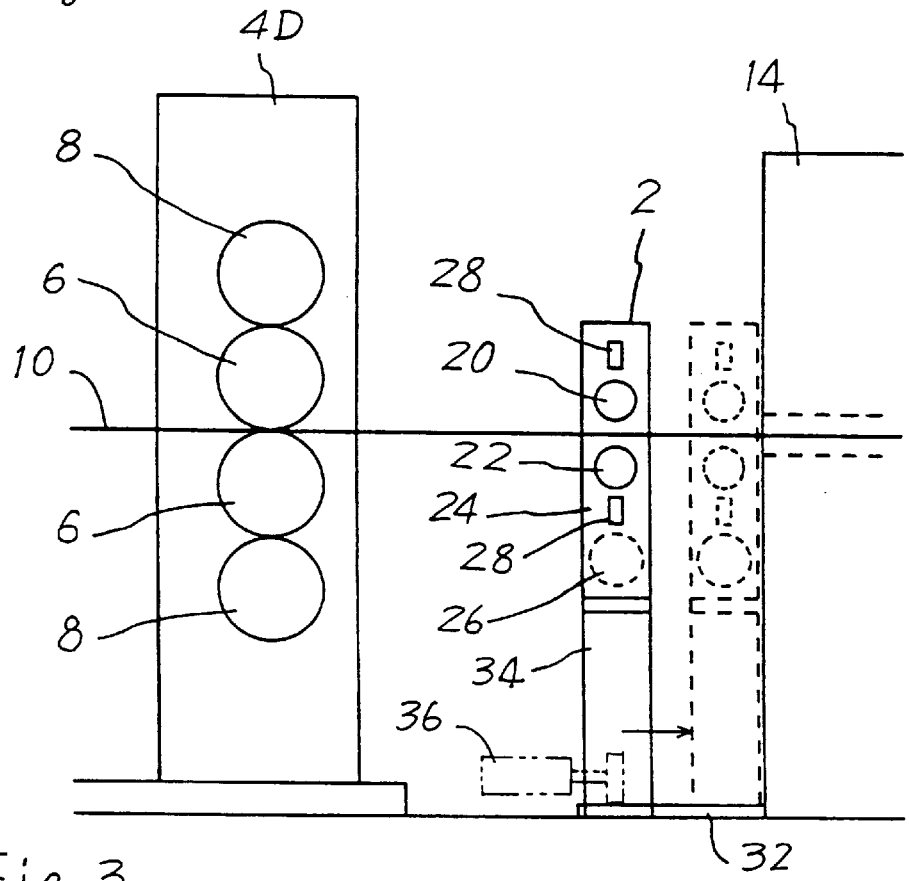
FIG. 2 is an explanatory view of a preferred embodiment of the invention.

The anti-wrap device 2 includes anti-wrap means disposed between printing cylinders 6 and 8 and a processing device which is disposed downstream of the printing cylinders 6 and 8 in the printing press. In the embodiment, the processing device comprises the dryer unit 14, the anti-wrap means comprising upper and lower anti-wrap rollers 20 and 22 and a frame 24, as shown in FIG. 2, which are disposed between the last printing unit 4D and the dryer unit 14. The anti-wrap rollers 20 and 22 are mounted on carriages for rotation, the carriages being supported on the frame 24 for vertical movement. The frame 24 includes a drive motor mounted thereon and connected to the anti-wrap rollers 20 and 22 through pulleys 26 and chains so that the anti-wrap rollers 20 and 22 are rotated by the drive motor at a speed corresponding to or slightly greater than the operating speed of the printing units 4A to 4D. The structure of the frame 24 is disclosed in detail with the carriages, the drive motor, the pulleys 26 and the chains in the above U.S. Patents.

As to the carriages of the anti-wrap rollers 20 and 22, the frame 24 includes actuators such as cylinders 28 mounted thereon and connected to the carriages. In this connection, the anti-wrap means includes detectors not shown but mounted on the frame 24 to detect a web break. In addition, detectors 30 are disposed in the dryer unit 14 as shown in FIG. 1, to detect a web break. The carriages are moved vertically along the frame 24 by the cylinders 28 in response to a signal from one of the detectors when the web 10 is broken, so that the anti-wrap rollers 20 and 22 are engaged with each other to capture the broken web 10 therebetween. The anti-wrap rollers 20 and 22 pull the broken web 10 from the last printing unit 4D for preventing the broken web 10 from wrapping around the printing cylinders 6 and 8. The web 10 is directed from the last printing unit 4D by the anti-wrap rollers 20 and 22 and harmlessly gathered in the shop floor space between the anti-wrap rollers 20 and 22 and the dryer unit 14, as shown in FIG. 1.

The printing press is slowed and stopped in response to the signal from one of the detectors when web 10 is broken. The printing press is operated so that the web 10 is fed at a running speed of 550 m/min in normal operation. In this connection, it takes 8 to 10 seconds to stop the printing press after the web 10 is broken. The broken web 10 is directed and gathered for 30 min length in the shop floor space.

The anti-wrap device further comprises guide means for guiding the anti-wrap rollers 20 and 22 and the frame 24 for movement between a first position shown in solid line and a second position shown in dotted line in FIG. 2. The guide means is arranged to guide the anti-wrap rollers 20 and 22 for movement in the web feeding direction.

The guide means comprises rail means 32 extending between the first and second positions. The frame 24 is mounted on a table 34 which is supported on the rail means 32 for movement, the rail means 32 comprising rails extending parallel to each other, the anti-wrap rollers 20 and 22, the frame 24 and the table 34 being movable along the rails 32.

In the printing operation, the anti-wrap rollers 20 and 22 and the frame 24 are disposed in the first position shown in solid line, in which the anti-wrap rollers 20 and 22 fulfill the function to prevent the broken web 10 from wrapping. The anti-wrap rollers 20 and 22 are positioned apart from the dryer unit 14 so as to create a shop floor space therebetween so that the broken web 10 can be harmlessly gathered in the shop floor space when directed from the last printing unit 4D by the anti-wrap rollers 20 and 22. The frame 24 is also positioned apart from the dryer unit 14 so as to keep the frame 24 and the detectors thereof from being heated by the dryer unit 14, the detectors being not damaged.

After the printing operation, the anti-wrap rollers 20 and 22, the frame 24 and the table 34 can be moved from the first position to the second position shown in dotted line, in which the anti-wrap rollers 20 and 22 are moved away from the first position and toward the dryer unit 14 to create a working space between the anti-wrap rollers 20 and 22 and the last printing unit 4D for making preparations for the printing operation. An operator can use the space to mount plates onto the plate cylinders 8, then inspect in the space how the plates are mounted on the plate cylinders 8, and inspect in the space the dirt of the plates. The operator can further use the space to exchange the blankets of the blanket cylinders 6 for new ones, and watch in the space the ink and dampening water in the printing press. The anti-wrap rollers 20 and 22, the frame 24 and the table 34 are then moved back to the first position for next printing operation.

Accordingly, the printing press may comprise an existing press which has merely a limited space between the last printing unit 4D and the dryer unit 14. The anti-wrap rollers 20 and 22 and the frame 24 can be additionally installed between the last printing unit 4D and the dryer unit 14 in the existing press to prevent a broken web 10 from wrapping around the printing cylinders 6 and 8, without any problem.

The anti-wrap rollers 20 and 22, the frame 24 and the table 34 are preferably moved between the first and second positions when the printing press is stopped and the web 10 is not fed. However, the anti-wrap rollers 20 and 22 may be moved when the printing press is not stopped and the web 10 is fed. The anti-wrap rollers 20 and 22 are preferably moved when the web 10 is fed at a running speed of over 150 m/min since the web 10 would be unstable and waved at a running speed of under 150 m/min and can not be kept from being engaged with the anti-wrap rollers 20 and 22. In addition, the anti-wrap rollers 20 and 22 are preferably moved when the web 10 is fed at a running speed of under 250 m/min since the web 10 may be broken by the anti-wrap rollers 20 and 22 if the web 10 is fed at a running speed of over 250 m/min and engaged with the anti-wrap rollers 20 and 22 so that the blankets can be damaged more severely by the broken web.

The anti-wrap device may further comprises actuator means such as air or hydraulic cylinders 36 which are connected to the table 34 for moving the anti-wrap rollers 20 and 22 between the first and second positions. The cylinders 36 may be arranged to move the anti-wrap rollers 20 and 22 in response to a signal from the printing press. The printing press may generate the signal in relation to the printing speed so that the anti-wrap rollers 20 and 22 are moved when the web 10 is fed at a running speed of 150 to 250 m/min.

Figure 3:
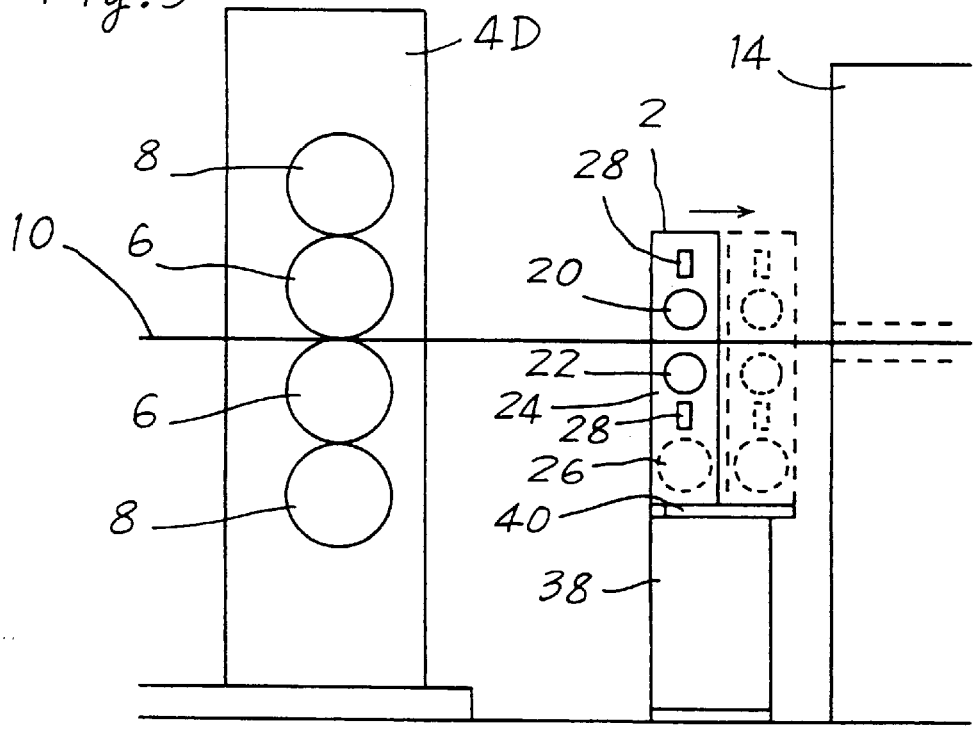
FIG. 3 is an explanatory view of another embodiment.

In another embodiment in FIG. 3, the frame 24 is mounted on a table 38 disposed between the printing cylinders 6 and 8 and the dryer unit 14. The table 38 includes guide means for guiding the anti-wrap rollers 20 and 22 and the frame 24 for movement relative to the table 38. The guide means comprises rail means 40 formed on the top of the table 38, the frame 24 being supported on the rail means 40 for movement between the first and second positions. In the printing operation, the anti-wrap rollers 20 and 22 and the frame 24 are disposed in the first position shown in solid line, in which the anti-wrap rollers 20 and 22 fulfill the function to prevent the broken web 10 from wrapping. After the printing operation, the anti-wrap rollers 20 and 22 and the frame 24 can be moved from the first position to the second position shown in dotted line, in which the anti-wrap rollers 20 and 22 are moved away from the first position and toward the dryer unit 14, to create a working space between the anti-wrap rollers 20 and 22 and the last printing unit 4D for making preparations for the printing operation.

Figure 4:
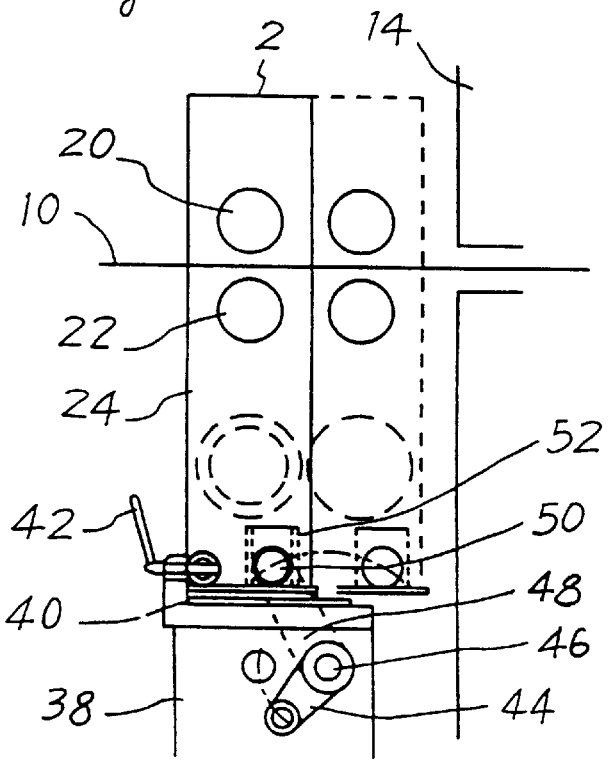
FIG. 4 is a side view of the means for moving the anti-wrap means in FIG. 3.

In the anti-wrap device in FIG. 3, a cramp lever 42 may be mounted on the table 38 for locking the frame 24 in the first position, as shown in FIG. 4. A handle 44 may be fixedly mounted on a shaft 46 which is supported on the table 38 for rotation. The shaft 46 includes arms 48 fixedly mounted thereon, rollers 50 being mounted on the arms 48 for rotation and fitted between guide plates 52 which are fixedly mounted on the frame 24. The handle 44 is manually rotated about the shaft 46 so that the rollers 50 are pushed against and rolled along the guide plates 52 in accordance with the rocking movement of the arms 48 to linearly move the anti-wrap rollers 20 and 22 and the frame 24 between the first and second positions.

Figure 5:
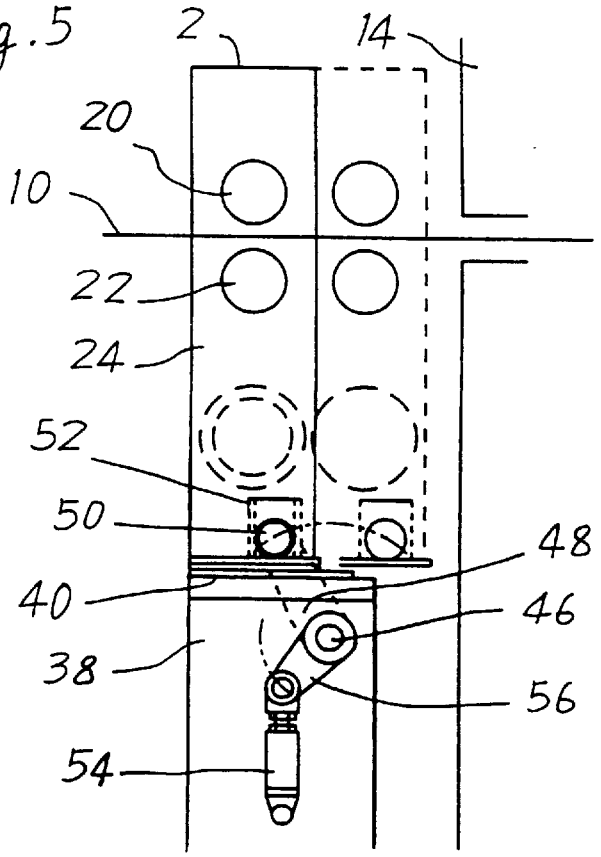
FIG. 5 is a side view of other embodiment.
Figure 6:
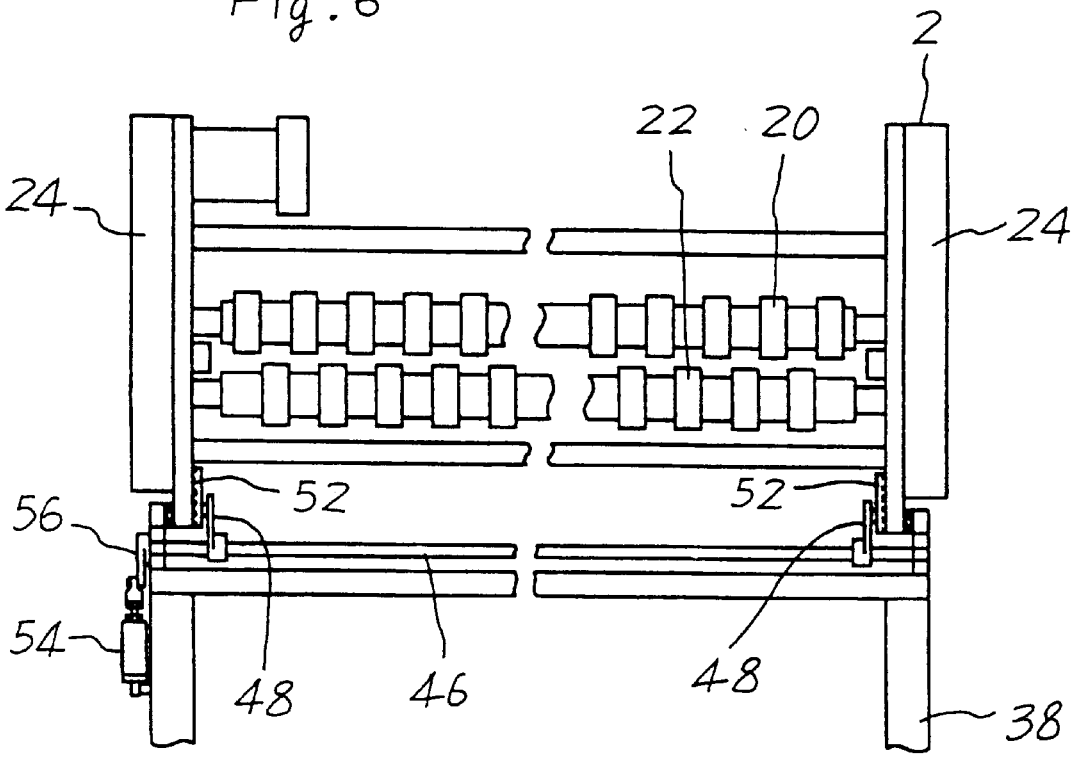
FIG. 6 is an elevational view of the anti-wrap means in FIG. 5.

Actuator means such as an air or hydraulic cylinder 54 may be mounted on the table 38 and connected to a link 56, as shown in FIG. 5. The link 56 is fixedly mounted on the shaft 46 in stead of the handle 44, for moving the anti-wrap rollers 20 and 22 and the frame 24 between the first and second positions. The shaft 46 extends widthwise of the anti-wrap device 2 and includes the arms 48 fixedly mounted thereon, as shown in FIG. 6. The cylinder 54 may be arranged to move the anti-wrap rollers 20 and 22 and the frame 24 in response to a signal from the printing press. The printing press may generate the signal in relation to the printing speed so that the anti-wrap rollers 20 and 22 are moved when the web 10 is fed at a running speed of 150 to 250 m/min.

Figure 7:
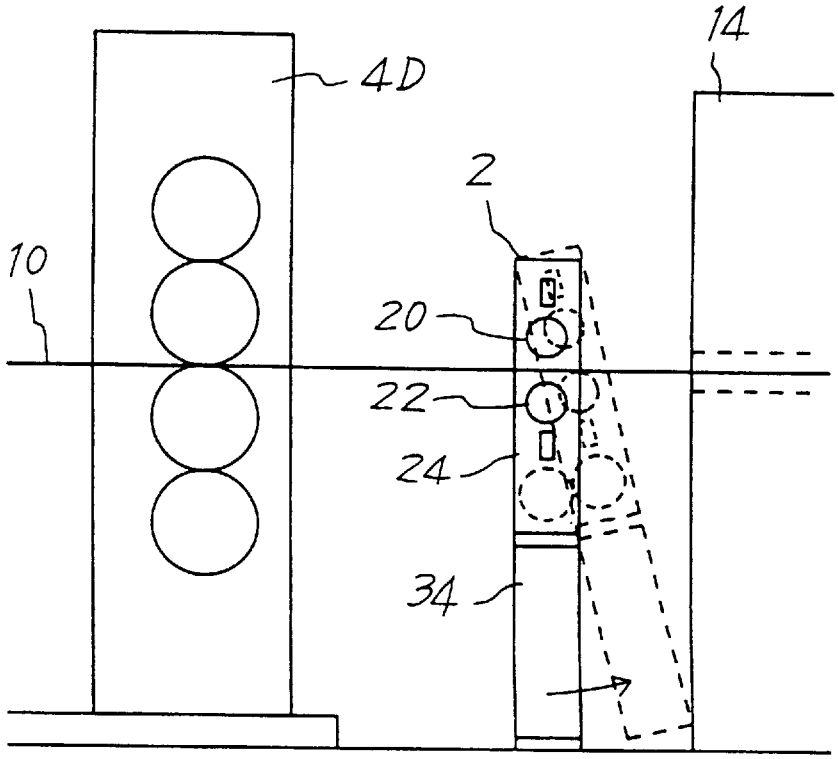
FIG. 7 is a side view of other embodiment.
Figure 8:
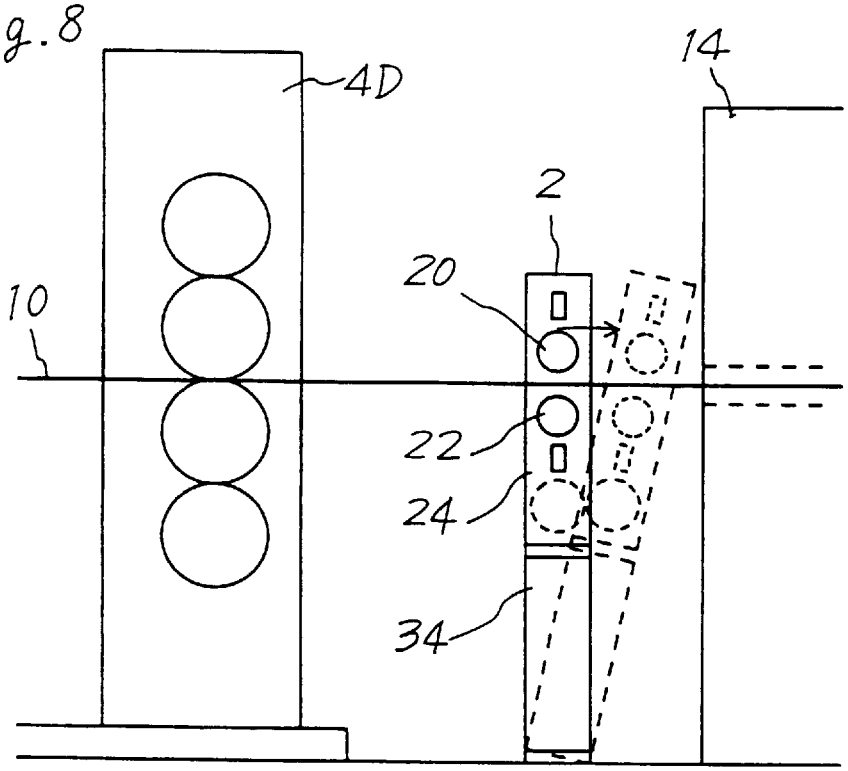
FIG. 8 is a side view of other embodiment.

The guide means may be arranged to guide the anti-wrap means for pivotal movement about the upper or lower end of the anti-wrap device 2 from the first position to the second position to create the working space. For example, the guide means may comprise support pins extending widthwise of the anti-wrap device 2, the frame 24 being supported at upper end by the support pins to guide the anti-wrap rollers 20 and 22, the frame 24 and the table 34 for pivotal movement about the upper end of the frame 24, as shown in FIG. 7. The table 34 may be supported at lower end by the support pins to guide the anti-wrap rollers 20 and 22, the frame 24 and the table 34 for pivotal movement about the lower end of the table 34, as shown in FIG. 8.

Figure 9:
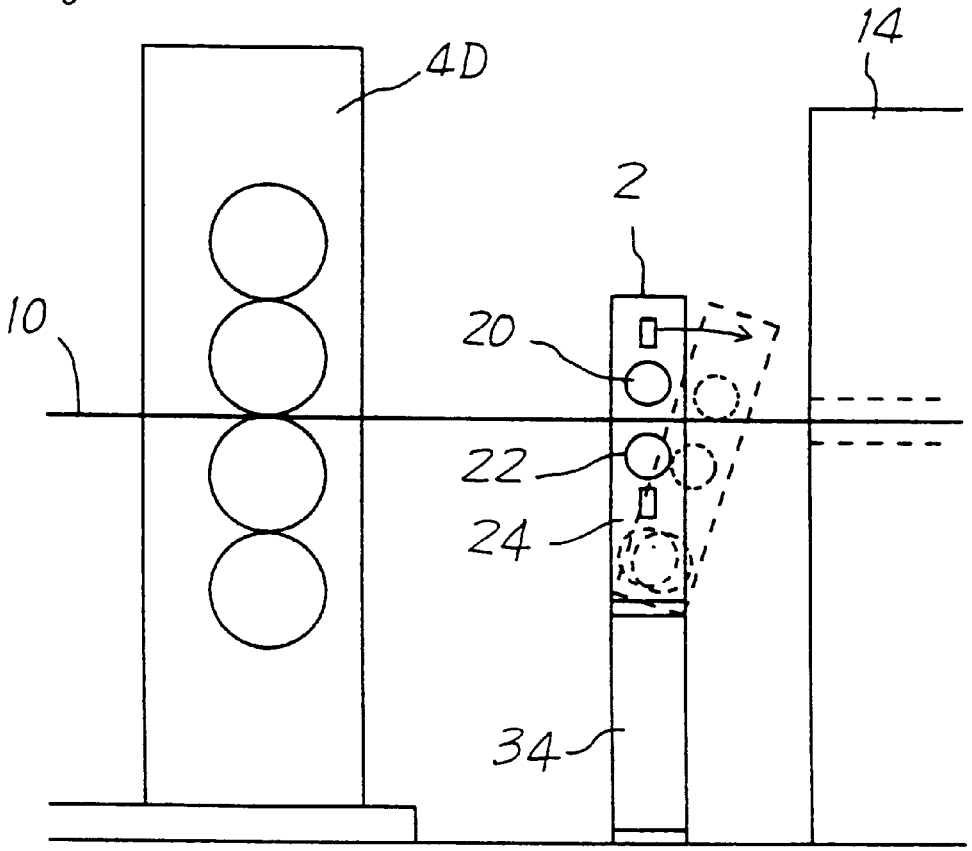
FIG. 9 is a side view of other embodiment.

The table 34 may include guide means for guiding the anti-wrap means for pivotal movement relative to the table 34. For example, the guide means may comprise support pins mounted on the table 34 and extending widthwise of the anti-wrap device 2, the frame 24 being supported at lower end by the support pins to guide the anti-wrap rollers 20 and 22 and the frame 24 for pivotal movement relative to the table 34, as shown in FIG. 9.

In other embodiment, the anti-wrap rollers 20 and 22 may be moved away from the first position to the second position toward the last printing unit 4D to create a working space between the anti-wrap rollers 20 and 22 and the dryer unit 14 for maintenance of the dryer unit 14. The anti-wrap rollers 20 and 22 may be disposed between the printing cylinders 6 and 8 and a processing device other than the dryer unit 14 and moved to the second position to create a working space between the anti-wrap rollers 20 and 22 and the processing device for maintenance of the processing device.

Figure 10:
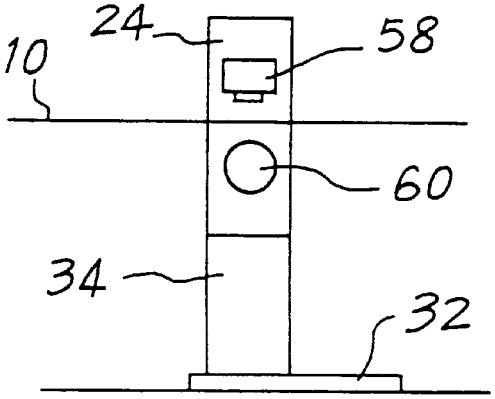
FIG. 10 is an explanatory view of other embodiment.
Figure 11:
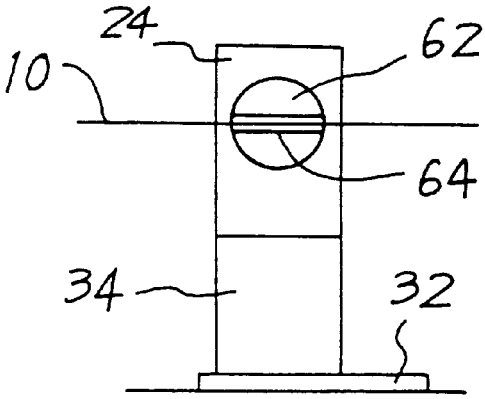
FIG. 11 is an explanatory view of other embodiment.

The anti-wrap means may comprise an upper air nozzle 58 and a lower anti-wrap roller 60, as shown in FIG. 10. Air is directed from the nozzle 58 to the web 10 when the web 10 is broken, so that the broken web 10 is engaged with the anti-wrap roller 60. The anti-wrap roller 60 is rotated by a drive motor to pull the broken web 10 from the last printing unit 4D for preventing the broken web 10 from wrapping around the printing cylinders 6 and 8. The anti-wrap means may also comprise a single anti-wrap roller 62 which includes a passage 64 formed therein and extending diametrically of the anti-wrap roller 62, as shown in FIG. 11. The web 10 is fed through the passage 64 in the anti-wrap roller 62. The anti-wrap roller 62 is rotated by a drive motor when the web 10 is broken, to wind the broken web 10 around the anti-wrap roller 62 and pull it from the last printing unit 4D for preventing the broken web 10 from wrapping around the printing cylinders 6 and 8.

What is claimed is:

1. A web anti-wrap device for a web printing press comprising:

anti-wrap means disposed between printing cylinders and a processing device which is positioned downstream of the printing cylinders in the printing press, to prevent a broken web from wrapping around the printing cylinders; and guide means for guiding said anti-wrap means for movement between a first position in which said anti-wrap means fulfills the function to prevent the broken web from wrapping, a second position in which said anti-wrap means is moved away from said first position to create a working space between said anti-wrap means and said printing cylinders or between said anti-wrap means and said processing device, wherein said guide means comprises rail means extending between said first and second positions, said anti-wrap means being movable along said rail means.

2. A web anti-wrap device for a web printing press comprising:

anti-wrap means disposed between printing cylinders and a processing device which is positioned downstream of the printing cylinders in the printing press, to prevent a broken web from wrapping around the printing cylinders; and guide means for guiding said anti-wrap means for movement between a first position in which said anti-wrap means fulfills the function to prevent the broken web from wrapping, and a second position in which anti-wrap means is moved away from said first position to create a working space between said anti-wrap means and said printing cylinders or between said anti-wrap means and said processing device, wherein said anti-wrap means is mounted on a table disposed between said printing cylinders and said processing device, said table including said guide means for guiding said anti-wrap means for movement relative to said table.

3. A web anti-wrap device for a web printing press comprising:

anti-wrap means disposed between printing cylinders and a processing device which is positioned downstream of the printing cylinders in the printing press, to prevent a broken web from wrapping around the printing cylinders; and guide means for guiding said anti-wrap means for movement between a first position in which said anti-wrap means fulfills the function to prevent the broken web from wrapping, and a second position in which anti-wrap means is moved away from said first position to create a working space between said anti-wrap means and said printing cylinders or between said anti-wrap means and said processing device, wherein said guide means is arranged to guide said anti-wrap means for pivotal movement about the upper or lower end of said anti-wrap device from said first position to said second position to create said working space.

4. A web anti-wrap device for a web printing press comprising:

anti-wrap means disposed between printing cylinders and a processing device which is positioned downstream of the printing cylinders in the printing press, to prevent a broken web from wrapping around the printing cylinders; and guide means for guiding said anti-wrap means for movement between a first position in which said anti-wrap means fulfills the function to prevent the broken web from wrapping, and a second position in which said anti-wrap means is moved away from said first position to create a working space between said anti-wrap means and said printing cylinders or between said anti-wrap means and said processing device, wherein said anti-wrap means is mounted on a table disposed between said printing cylinders and said processing device, said table including said guide means for guiding said anti-wrap means for pivotal movement relative to said table.

* * * * *